US010584478B2

(12) United States Patent
Wong et al.

(10) Patent No.: US 10,584,478 B2
(45) Date of Patent: Mar. 10, 2020

(54) BUILDING FRAME STRUCTURE HAVING EDGE BEAM AND CONSTRUCTION METHOD THEREOF

(71) Applicant: Yau Lee Wah Concrete Precast Products (Shenzhen) Company Limited, Shenzhen (CN)

(72) Inventors: Conrad Tin Cheung Wong, Shenzhen (CN); Rosana Wai Man Wong, Shenzhen (CN)

(73) Assignee: Yau Lee Wah Concrete Precast Products (Shenzhen) Company Limited, Shenzhen, Guangzhou (CN)

( * ) Notice: Subject to any disclaimer, the term of this patent is extended or adjusted under 35 U.S.C. 154(b) by 0 days.

(21) Appl. No.: 16/102,743

(22) Filed: Aug. 14, 2018

(65) Prior Publication Data

US 2019/0048575 A1 Feb. 14, 2019

(30) Foreign Application Priority Data

Aug. 14, 2017 (CN) ..... 2017 1 0690237

(51) Int. Cl.

| | |
|---|---|
| ***E04B 5/16*** | (2006.01) |
| ***E04B 1/34*** | (2006.01) |
| ***E04B 1/20*** | (2006.01) |

(52) U.S. Cl.

CPC ..... *E04B 1/34* (2013.01); *E04B 1/20* (2013.01); *E04B 2103/02* (2013.01)

(58) Field of Classification Search

CPC ..... E04B 5/28; E04B 5/17; E04B 2005/173; E04B 5/19; E04B 5/23; E04B 2005/322; E04B 5/36; E04B 5/38

See application file for complete search history.

(56) References Cited

U.S. PATENT DOCUMENTS 758,728 A * 5/1904 Wight ..... E04B 5/40 52/250
1,031,043 A * 7/1912 Conzelman ..... E04B 5/43 256/19

(Continued)

FOREIGN PATENT DOCUMENTS

CN 103362208 A 10/2013
CN 106049679 A 10/2016

(Continued)

*Primary Examiner* — Gisele D Ford

(74) *Attorney, Agent, or Firm* — Soroker Agmon Nordman PTE LTD

(57) ABSTRACT

Disclosed is a building frame structure having an edge beam and a construction method thereof. The frame structure includes: a main frame structure and a cantilever beam provided outside of the main frame structure, a beam supported by the cantilever beam, and an outer floor disposed between the main frame structure and the edge beam. The edge beam and the cantilever beam are preforms reserved with exposed reinforcing bars, respectively. The edge beam is provided thereon with a vertical sideboard and a temporary safety rail. The cantilever beam is a beam-shell structure provided with an inner recess. The outer floor is a laminated plate, a lower part of which is a preformed plate. The preformed plate, the edge beam, and the cantilever beam are connected to each other by concrete cast in situ at respective top portions thereof.

10 Claims, 7 Drawing Sheets

(56) References Cited

U.S. PATENT DOCUMENTS

| | | | | |
|---|---|---|---|---|
| 3,619,959 | A * | 11/1971 | Parker | E04B 5/29 52/223.6 |
| 2001/0003234 | A1* | 6/2001 | Van Doren | E04B 1/165 52/251 |
| 2002/0104281 | A1* | 8/2002 | Sanger | E04B 5/02 52/319 |
| 2003/0033758 | A1* | 2/2003 | Sanger | E04B 5/02 52/90.1 |
| 2003/0084629 | A1* | 5/2003 | Strickland | E04B 5/32 52/289 |
| 2004/0148885 | A1* | 8/2004 | Femminella | E04B 5/12 52/319 |
| 2009/0301011 | A1 | 12/2009 | Kollegger et al. | |
| 2011/0088348 | A1* | 4/2011 | Rahimzadeh | E04B 1/30 52/649.2 |
| 2016/0032580 | A1* | 2/2016 | Rahimzadeh | E04B 1/30 52/236.9 |
| 2017/0051498 | A1* | 2/2017 | Jeske | E04B 2/96 |

FOREIGN PATENT DOCUMENTS

| | | | |
|---|---|---|---|
| CN | 106638947 | A | 5/2017 |
| JP | H09-268651 | A | 10/1997 |

* cited by examiner

BUILDING FRAME STRUCTURE HAVING EDGE BEAM AND CONSTRUCTION METHOD THEREOF

TECHNICAL FIELD

The present invention relates to a building structure and a construction method thereof, and in particular, to a frame structure having an edge beam and a construction method thereof. The present invention is applicable to all buildings of frame structure or frame-shear structure.

BACKGROUND

It is necessary to provide a peripheral seal plate and to build an outside work frame during cast-in-situ construction of a conventional building frame structure having an edge beam, especially in a high-rise building. This not only takes working hours and thus is of high costs, but also is subjected to great security risks. Moreover, many modern buildings employ an exterior curtain wall design, which requires pre-embedding of curtain wall pre-inserts for fixing a curtain wall during construction. However, in a conventional cast-in-situ construction approach, reserved pre-inserts are, more often than not, subjected to large errors. This renders it difficult to accurately mount the curtain wall. In addition, concrete has to be cast in situ for a second time to build a curtain wall firewall, which is time-consuming.

SUMMARY

The technical problem to be solved by the present invention is to provide a building frame structure having an edge beam and a construction method thereof, so as to render it unnecessary to provide any peripheral seal plate or to build any work frame outside of a building, thereby significantly reducing on-site workload.

The technical solution of the present invention to the above technical problem is to design a building frame structure having an edge beam, comprising a main frame structure which includes a column, a beam, and an inner floor, a cantilever beam provided outside of the main frame structure, an edge beam supported on the cantilever beam, and an outer floor disposed between the main frame structure and the edge beam.

The edge beam is a preform reserved with an exposed reinforcing bar, and is provided thereon with a vertical sideboard and a temporary safety rail. The cantilever beam is a preform reserved with an exposed reinforcing bar, and has a beam-shell structure provided with an inner recess. The outer floor is a laminated plate, a lower part of which is a preformed plate. The preformed plate, the edge beam, and the cantilever beam are connected to each other by concrete cast in situ at respective top portions thereof.

Multiple notches are provided in the vertical sideboard of the edge beam, and curtain wall pre-inserts are arranged in advance at the notches respectively.

At a construction site, the notches are filled with concrete, to form a curtain wall firewall together with the vertical sideboard.

A periphery of a corner outer floor at each corner of a building is connected to the beam-shell structure provided with a recess therein.

The edge beam and its vertical sideboard are formed into one preform, and the temporary safety rail is secured to the vertical sideboard by means of a connector pre-embedded in the vertical sideboard.

An inner floor of the main frame structure is a laminated plate, a lower part of which is a preformed plate. The beam is a preform provided, at a top portion thereof, with a recess, and reserved with an exposed reinforcing bar. A preformed plate of the inner floor and the beam are connected, by concrete cast in situ at respective top portions thereof, to the outer floor, the edge beam, and the cantilever beam.

A construction method of the above building frame structure having an edge beam is further provided, comprising:

step A): cleaning up an $N^{th}$ floor, and preparing for construction on a current floor;

step B): mounting and securing, by means of a completed column, a support frame of a cantilever structure provided outside of a main frame structure, and hanging a safety net:

step C): mounting a support frame, and preparing for lifting of the preformed beam and a preformed plate;

step D): lifting the preformed beam and a preformed plate of the main frame structure, mounting, by means of the completed column, a reinforced oblique rod of the edge beam, and lifting a preformed cantilever beam, a preformed edge beam, and a preformed plate of the outer floor;

step E): strapping reinforcing bars on the preformed beam, the preformed plate of the main frame structure, the preformed plate of the outer floor, the preformed cantilever beam, and the preformed edge beam, respectively, to connect them together by means of cast-in-situ concrete; and step F): removing the support frame and the safety net of the $N^{th}$ floor when the cast-in-situ concrete achieves required strength.

In step D), the preformed edge beam and its vertical sideboard are lifted first, followed by mounting of a temporary safety rail by means of a connector pre-embedded in the vertical sideboard.

In step E), before concrete is cast in situ, an independent support piece is established below the preformed beam and the preformed plate.

The vertical sideboard of the edge beam is provided therein with multiple notches, at which curtain wall pre-inserts are arranged in advance, and in step E), concrete is cast into the notches.

The building frame structure having the edge beam and the construction method thereof according to the present invention, as respectively compared with those in the prior art, have the following advantages.

At the outset, the completely preformed edge beam is used, and the vertical sideboard and the temporary safety rail are mounted on the edge beam, thereby rendering it unnecessary to provide any peripheral seal plate at connection nodes, or to build any work frame outside of the building. This effectively reduces on-site workload and construction waste produced thereon, and improves construction efficiency. Besides, workers all work within the building, which ensures their safety.

Moreover, the curtain wall pre-inserts are embedded in advance in the preformed edge beam at factory with high accuracy in positions thereof. This can speed up and improve mounting of the curtain wall.

Further, the vertical sideboard provided on the edge beam is prepared at factory and can be used as the curtain wall firewall, thereby reducing, secondary cast-in-situ workload on the construction site.

DETAILED DESCRIPTION

The present invention will be described in further detail with reference to preferred embodiments shown in the accompanying drawings.

Figure 1:
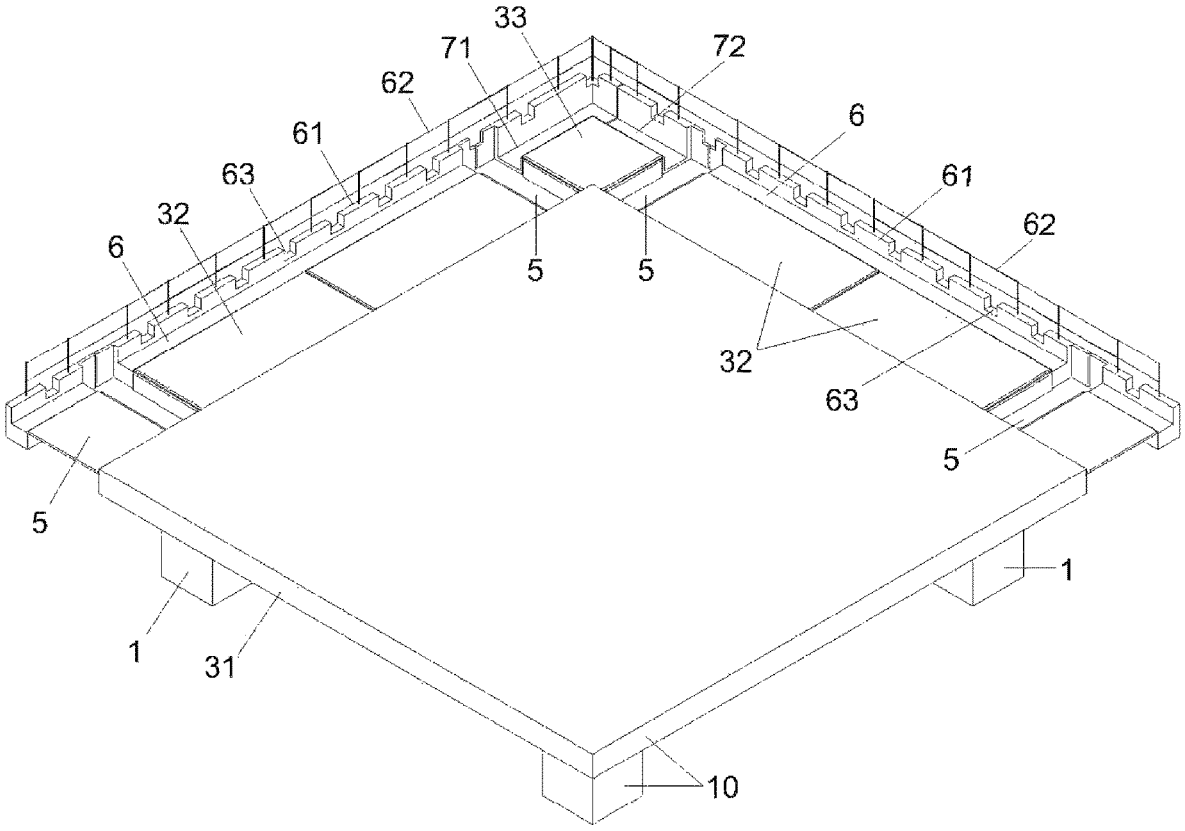
FIG. 1 schematically shows a perspective view of a building frame structure having an edge beam according to the present invention.
Figure 2:
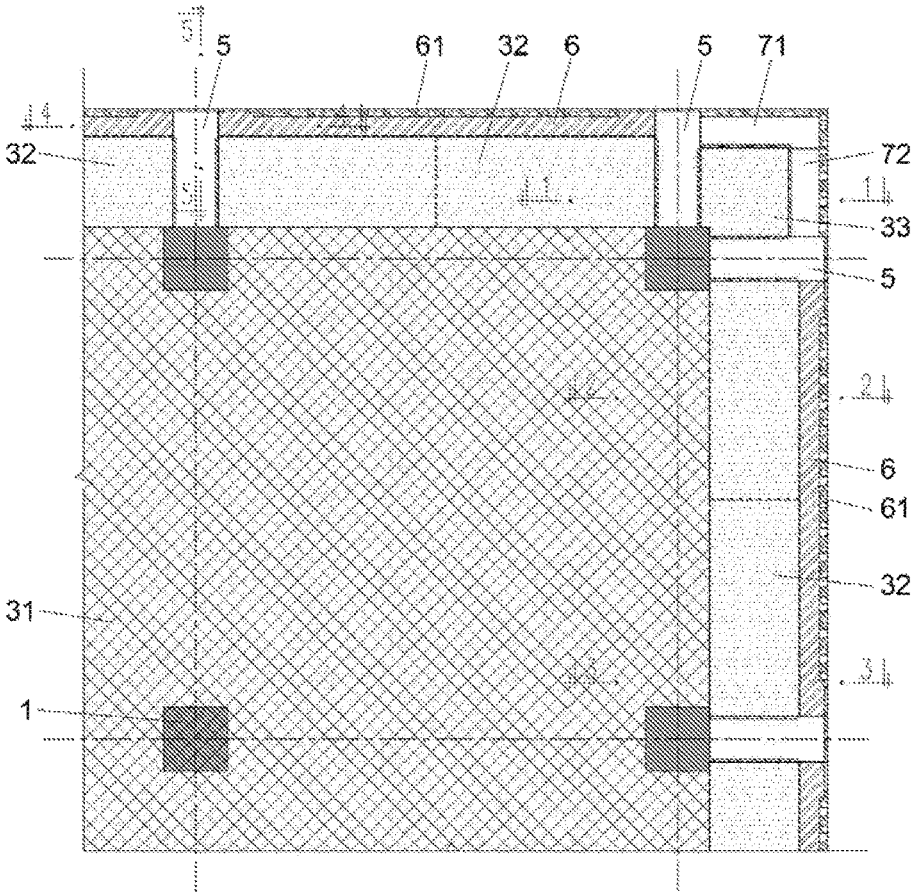
FIG. 2 schematically shows a planar view of the building frame structure having an edge beam according to the present invention.

As shown in FIGS. 1 and 2, a building frame structure having an edge beam of the present invention comprises: a main frame structure 10, a cantilever beam 5 provided on a periphery of the main frame structure 10, an edge beam 6 supported by the cantilever beam 5, and an outer floor 32 disposed between the main frame structure 10 and the edge beam 6, wherein the main frame structure 10 includes a column 1, a beam 2, and an inner floor 31.

Figure 8:
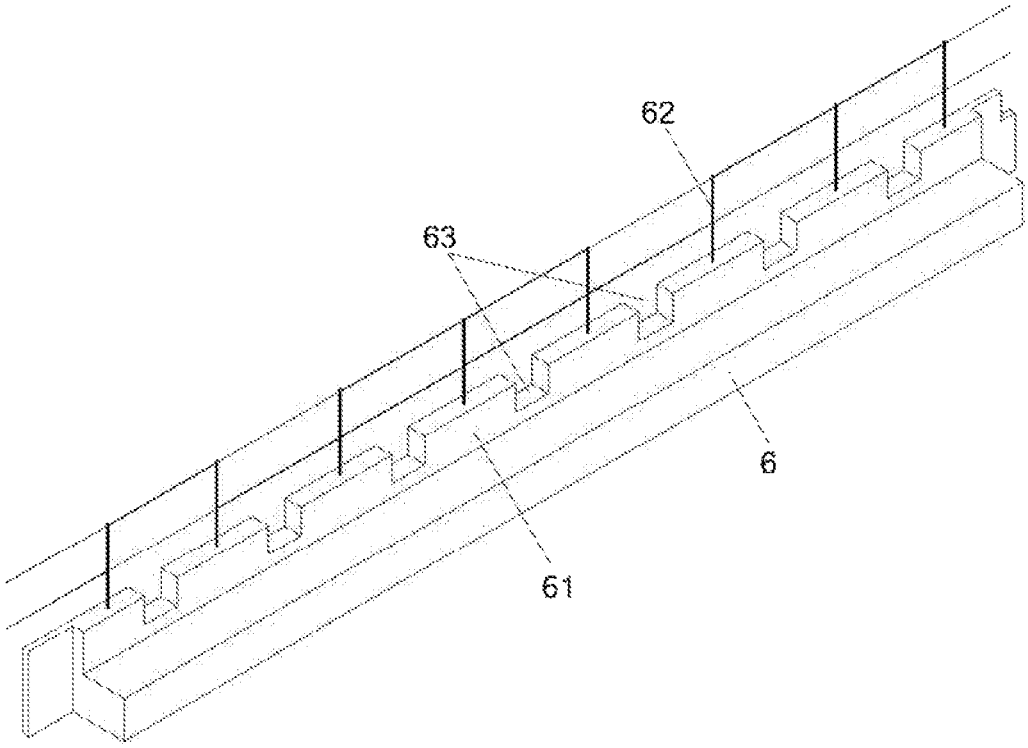
FIG. 8 schematically shows the structure of an edge beam 6 (without showing its exposed reinforcing bar as reserved)

As shown in FIG. 8, the edge beam 6, which is designed to be a simply supported beam, is preformed and reserved with an exposed reinforcing bar (not shown). An outer edge of the edge beam 6 is preformed with a vertical sideboard 61 and a temporary safety rail 62 mounted on the vertical sideboard 61, whereby it will be unnecessary to provide any peripheral seal plate at connection nodes, or to build any outside work tame at a periphery of a building on a construction site. Workers all work in the building, thereby ensuring their safety. In addition, multiple notches 63 are provided and spaced from each other in the vertical sideboard 61, with curtain wall pre-inserts being pre-arranged at the notches 63. Because the curtain wall pre-inserts are embedded in advance at factory, they can be positioned with high precision, which is favorable for accurate and rapid mounting of a curtain wall. At a construction site, concrete is cast into the notches 63, to form a curtain wall firewall together with the vertical sideboard 61. As a result, secondary on-site casting of concrete for a firewall will be unnecessary, thus significantly saving working hours.

Figure 6:
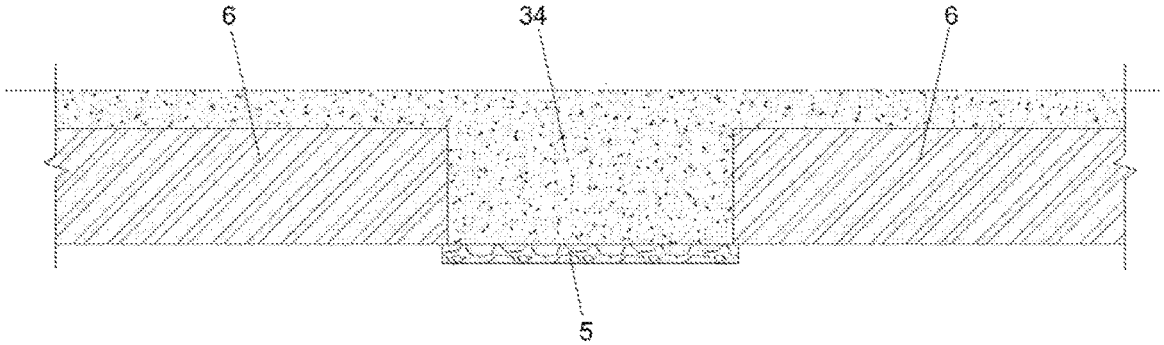
FIG. 6 shows a cross-section view of FIG. 2 along line 4-4.
Figure 7:
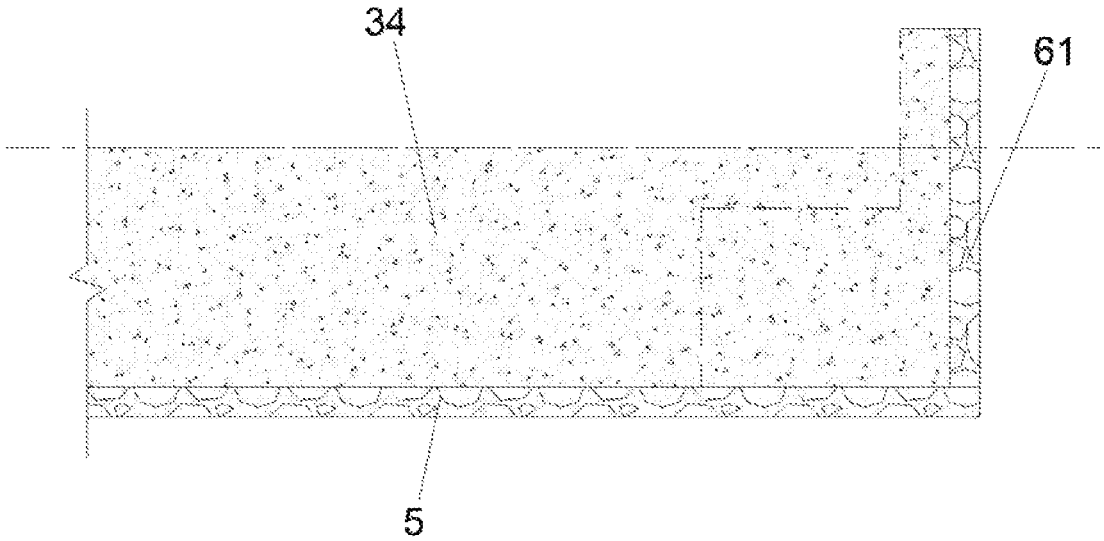
FIG. 7 shows a cross-section view of FIG. 2 along line 5-5.
Figure 9:
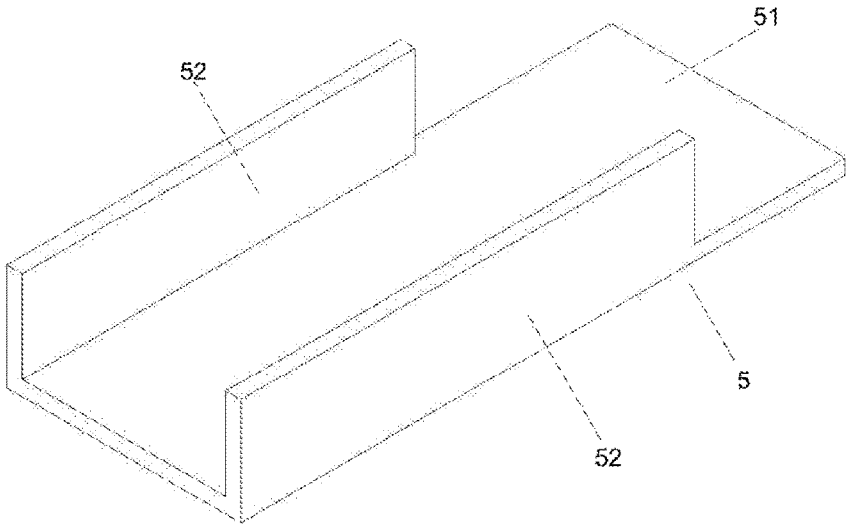
FIG. 9 schematically shows the structure of a cantilever beam 5 (without showing its exposed reinforcing bar as reserved)

As shown in FIG. 9, the cantilever beam 5 is also preformed and reserved with an exposed reinforcing bar (not shown). The preformed cantilever beam 5, which is a beam-shell structure provided with an inner recess, includes a bottom plate 51 and vertical side plates 52 arranged on both sides respectively. An outer end of the bottom plate 51 extends outwardly beyond outer ends of both side plates 52. As shown in FIGS. 6 and 7, an outer extension portion of the bottom plate 51 is supported at bottom portions of the vertical sideboard 61 and the edge beams 6 at two sides thereof.

Figure 3:
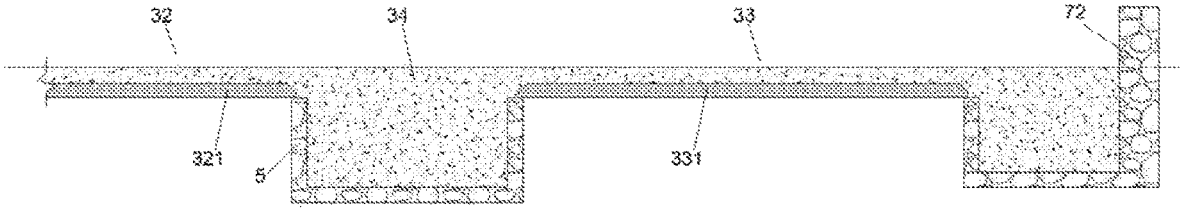
FIG. 3 shows a cross-section view of FIG. 2 along line 1-1.
Figure 4:
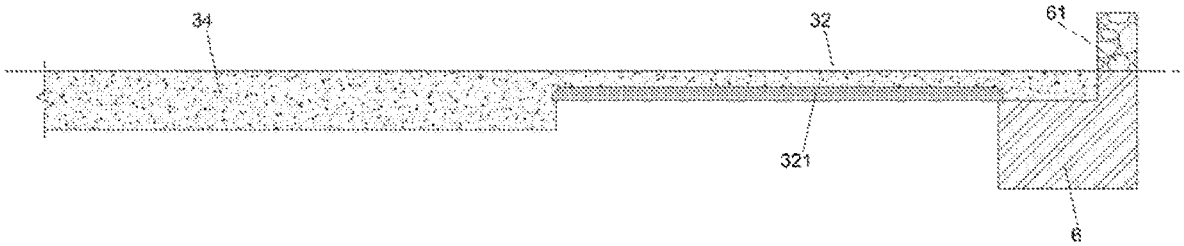
FIG. 4 shows a cross-section view of FIG. 2 along line 2-2.
Figure 5:
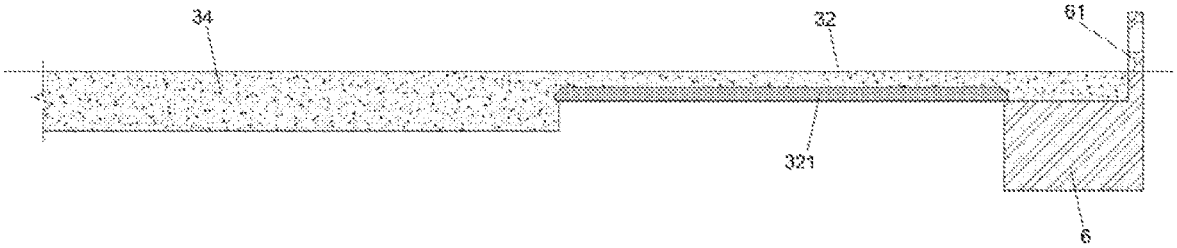
FIG. 5 shows a cross-section view of FIG. 2 along line 3-3.

The outer floor 32 has a laminated plate structure, with a preformed plate 321 at a lower portion and a cast-in-site structure at a top portion thereof. As shown in FIGS. 1 to 3, a square corner outer floor 33 is provided at each corner of the building. The square corner outer floor 33 also has a laminated plate structure, with its periphery being supported by top portions of four beam-shell structures respectively provided therein with recesses. The four beam-shell structures are a transverse cantilever beam 5, a vertical cantilever beam 5, a transverse beam-shell structure 71, and a vertical beam-shell structure 72, respectively. During on-site construction, as shown in FIGS. 4, 5, and 14, the preformed plate 321, the edge beam 6, the cantilever beams 5, and the beam-shell structures 71 and 72 are connected to each other by concrete cast in situ at respective top portions thereof.

Figure 13:
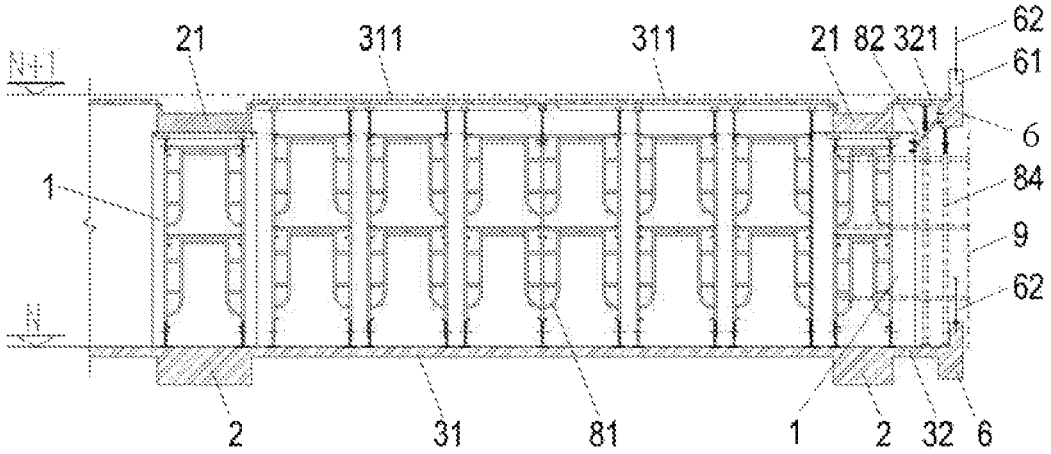
FIG. 13 schematically shows step D) of the construction method of the present invention.
Figure 14:
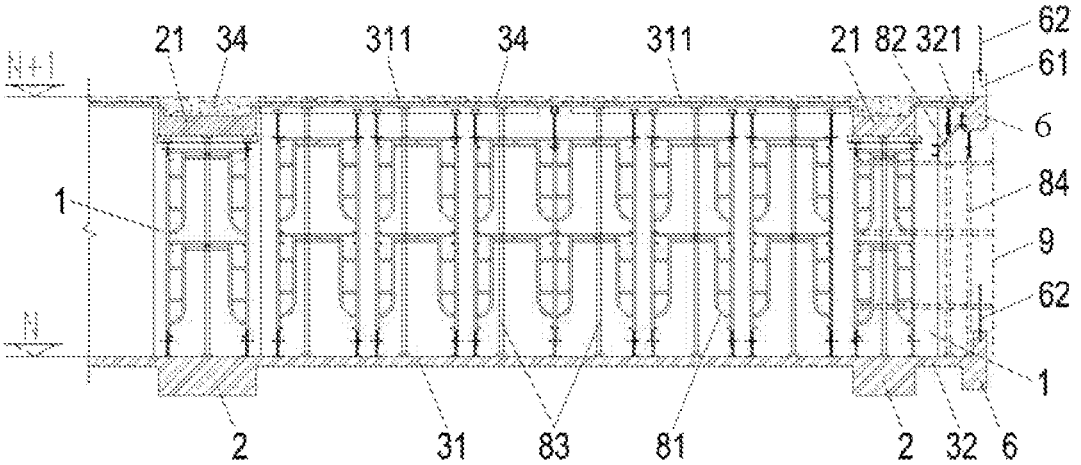
FIG. 14 schematically shows step E) of the construction method of the present invention.

In an embodiment of the present invention as shown in FIGS. 13 and 14, the inner floor 31 of the main frame structure 10 also has a laminated plate structure, with a lower portion thereof being a preformed plate 311. The beam 2 is a preform which is provided, at a top portion thereof, with a recess, and reserved with an exposed reinforcing bar. During on-site construction, the preformed plate of the inner floor 31, the beam 2, the peripheral outer floor 32, the cantilever beams 5, and the edge beam 6 are cast in situ, at respective top portions thereof, with concrete, so as to connect the main frame structure 10 to the outer floor 32, the edge beam 6, and the cantilever beams 5. With such a structure, onsite workload can be largely reduced, thereby accelerating construction progress.

The edge beam 6 and its vertical sideboard 61 are formed into one preform, and the temporary safety rail 62 is fixedly connected to the vertical sideboard 61 by means of a connector pre-embedded in the vertical sideboard 61. With such a structure, individual components thereof have a reduced size, which is favorable for transport and lifting of the edge beam 6.

A construction method of the building frame structure having the edge beam of the present invention comprises the following steps.

Figure 10:
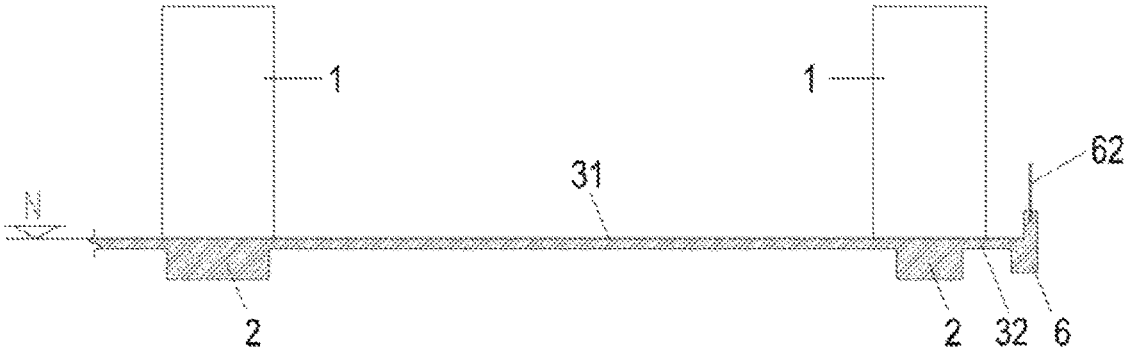
FIG. 10 schematically shows step A) of a construction method of the present invention.

In step A), as shown in FIG. 10, an $N^{th}$ floor is cleaned up, and a current floor is ready for construction after preparations. At this moment, concrete has been cast to complete the column 1 on this floor.

Figure 11:
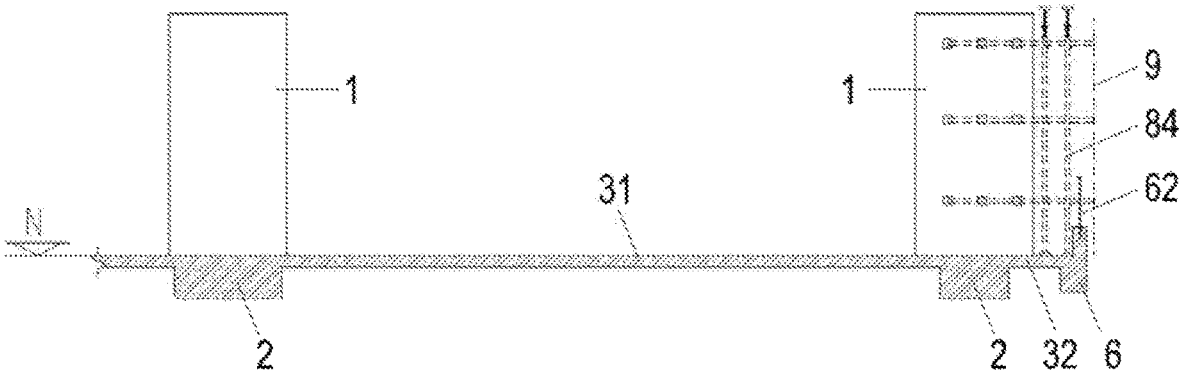
FIG. 11 schematically shows step B) of the construction method of the present invention.

In step B), as shown in FIG. 11, a support frame 84 of a cantilever structure provided outside of the main frame structure 10 is mounted and secured, by means of the completed column 1, and a peripheral safety net 9 is hung.

Figure 12:
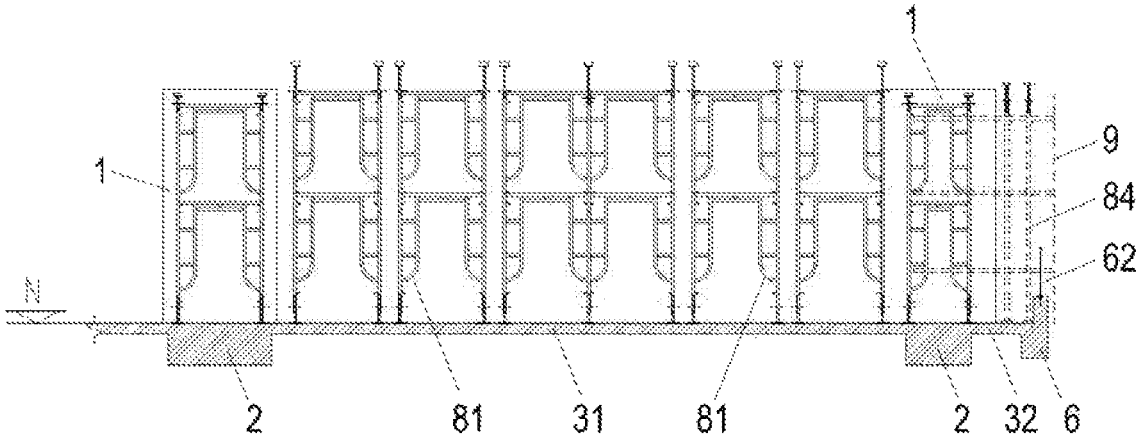
FIG. 12 schematically shows step C) of the construction method of the present invention.

In step C), as shown in FIG. 12, a support frame 81 of the main frame structure 10 is mounted, and a preformed beam 2 and the preformed plates are ready for construction after preparations.

In step D), as shown iii FIG. 13, the preformed beam 2 and the preformed plate 311 of the main frame structure 10 are lifted. A reinforced oblique rod 82 of the edge beam is mounted by means of the completed column 1. The preformed cantilever beam 5, a preformed edge beam 6, and the preformed plate 321 of the outer floor 32 are lifted. The temporary safety rail 62 is fixedly connected to the vertical sideboard 61 of the preformed edge beam 6 by means of the connectors pre-embedded therein. As the preformed edge beam 6 is provided thereon with the vertical sideboard 61 and the temporary safety rail 62, it will be unnecessary to provide any peripheral seal plate at connection nodes, or to build any outside frame work at the periphery of the building at the construction site.

In step E), as shown in FIG. 14, an independent support piece 83 is established below the preformed beam 2 and the preformed plate 311, and reinforcing bars are strapped on the preformed beam 2, the preformed plates 311, 321, and 331, the preformed cantilever beam 5, and the preformed edge beam 6, to connect them together by means of cast-in-site concrete. Meanwhile, concrete is cast in situ into the recesses 63 of the vertical sideboard 61 of the edge beam 6.

Figure 15:
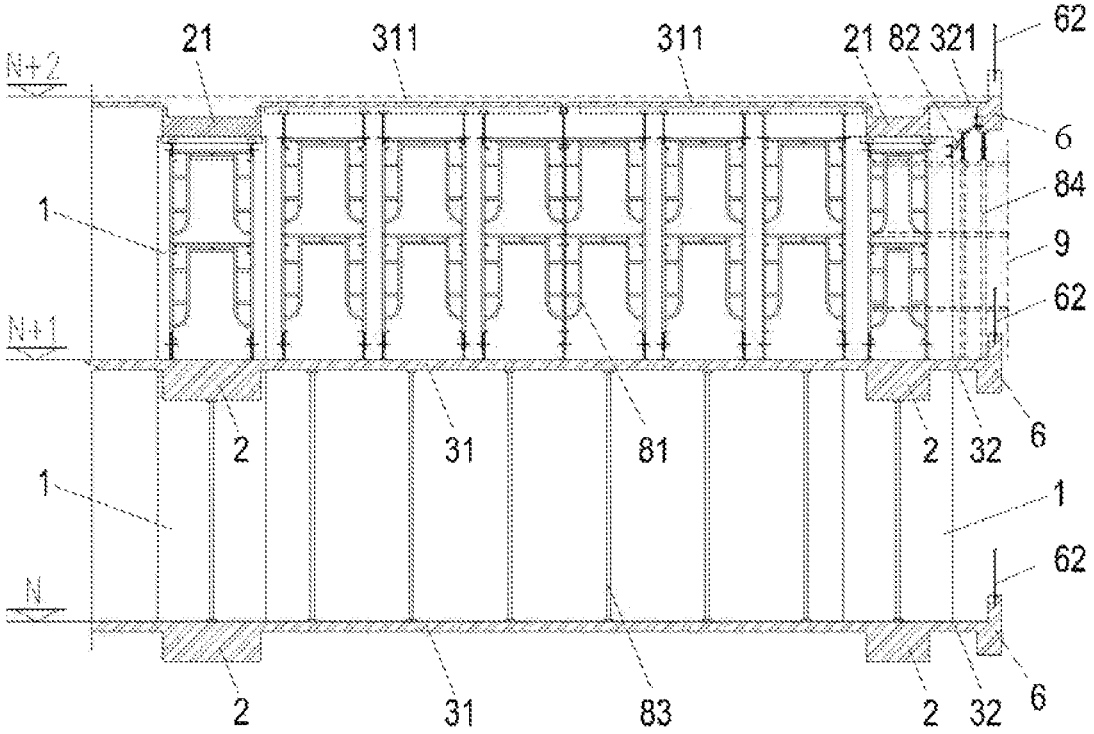
FIG. 15 schematically shows step F) of the construction method of the present invention.

In step F), as shown in FIG. 15, the support frame 81 and the safety net 9 of the $N^{th}$ floor are removed when the cast-in-situ concrete achieves required strength, while the temporary safety rail 62 is retained until construction is completed.

The above steps can be repeated to complete construction of multiple floors.

The foregoing description is merely illustrative of preferred embodiments of the present invention, and is not intended to limit the present invention. Various changes and modifications may be made by those skilled in the art. Any modifications, equivalent substitutions, improvements, and the like within the spirit and principles of the present invention are intended to be included within the scope of the present invention.

The invention claimed is:

1. A building frame structure having an edge beam, comprising:

a main frame structure (10) which includes a column (1), a first beam (2), and an inner floor (31), a cantilever beam (5) provided outside of the main frame structure (10), an edge beam (6) supported by the cantilever beam (5), and an outer floor (32) disposed between the main frame structure (10) and the edge beam (6), wherein the edge beam (6) is a precast element provided with an exposed reinforcing bar, the edge beam (6) being provided thereon with a vertical sideboard (61) and a temporary safety rail (62);

wherein the cantilever beam (5) is a precast element provided with an exposed reinforcing bar, the cantilever beam (5) having a beam-shell structure provided with an inner recess;

wherein the outer floor (32) is a laminated plate, a lower part of which is a precast plate (321); and wherein the precast plate (321), the edge beam (6), and the cantilever beam (5) are connected to each other by concrete cast in situ at respective top portions thereof.

2. The building frame structure having an edge beam according to claim 1, wherein multiple notches (63) are provided in the vertical sideboard (61) of the edge beam (6), and a curtain wall pre-insert is arranged at each of the notches (63).

3. The building frame structure having an edge beam according to claim 2, wherein the notches (63) filled with concrete form a curtain wall firewall together with the vertical sideboard (61).

4. The building frame structure having an edge beam according to claim 1, wherein a periphery of a corner outer floor at each corner of a building is connected to the beam-shell structure provided with a recess therein.

5. The building frame structure having an edge beam according to claim 1, wherein the edge beam (6) and its vertical sideboard (61) are formed into one piece, and the temporary safety rail (62) is secured to the vertical sideboard (61) by means of a connector pre-embedded in the vertical sideboard (61).

6. The building frame structure having an edge beam according to claim 1, wherein the inner floor (31) of the main frame structure (10) is a laminated plate, a lower part of which is a precast plate, wherein the first beam (2) is a precast element provided, at a top portion thereof, with a recess, and provided with an exposed reinforcing bar, and wherein a precast plate of the inner floor (31) and the first beam (2) are connected, by concrete cast in situ at respective top portions thereof, to the outer floor (32), the edge beam (6), and the cantilever beam (5).

7. A construction method of the building frame structure having an edge beam according to claim 1, comprising:

step A): cleaning up an $N^{th}$ floor, and preparing for construction on a current floor;

step B): mounting and securing, by means of a completed column (1), a support frame of a cantilever structure provided outside of a main frame structure (10), and hanging a safety net (9);

step C): mounting a support frame (81), and preparing for lifting of a precast beam and a precast plate;

step D): lifting the first beam (2) and a precast plate of the main frame structure (10), mounting, by means, of the completed column (1), a reinforced oblique rod (82) of the edge beam, and lifting a precast cantilever beam (5), a precast edge beam (6), and a precast plate (321) of the outer floor (32);

step E): strapping reinforcing bars on the first beam (2), the precast plate of the main frame structure (10), the precast plate of the outer floor (32), the precast cantilever beam (5), and the precast edge beam (6), respectively, to connect them together by means of cast-in-site concrete; and step F): removing the support frame (81) and the safety net (9) of the $N^{th}$ floor when the cast-in-situ concrete achieves required strength.

8. The construction method of the building frame structure having an edge beam according to claim 7, wherein in step D), the precast edge beam (6) and its vertical sideboard (61) are lifted first, followed by mounting of the temporary safety rail (62) by means of a connector pre-embedded in the vertical sideboard (61).

9. The construction method of the building frame structure having an edge beam according to claim 7, wherein in step F), before the concrete is cast in situ, an independent support piece (83) is established below the first beam (2) and the precast plate of the main frame structure (10).

10. The construction method of the building frame structure having an edge beam according to claim 7, wherein the vertical sideboard (61) of the edge beam is provided therein with multiple notches (63), at which curtain wall pre-inserts are arranged, and wherein in step E), concrete is cast into the notches (63).

* * * * *